US010206845B1

(12) United States Patent
Barouche

(10) Patent No.: US 10,206,845 B1
(45) Date of Patent: Feb. 19, 2019

(54) CALF STRETCHING APPARATUS

(71) Applicant: David Barouche, Miami Beach, FL (US)

(72) Inventor: David Barouche, Miami Beach, FL (US)

( * ) Notice: Subject to any disclaimer, the term of this patent is extended or adjusted under 35 U.S.C. 154(b) by 0 days.

(21) Appl. No.: 16/103,004

(22) Filed: Aug. 14, 2018

(51) Int. Cl.
*A63B 21/00* (2006.01)
*A61H 1/02* (2006.01)
*A63B 23/00* (2006.01)

(52) U.S. Cl.
CPC ..... *A61H 1/0237* (2013.01); *A61H 2201/164* (2013.01); *A63B 21/00047* (2013.01); *A63B 2023/006* (2013.01)

(58) Field of Classification Search
CPC ..... A61H 1/0237; A61H 2201/164; A63B 21/00047; A63B 2023/006; A63B 23/00; A63B 23/85; A63B 23/12
See application file for complete search history.

(56) References Cited

U.S. PATENT DOCUMENTS

D251,313 S * 3/1979 Jinotti ..... D21/685
4,159,111 A * 6/1979 Lowth ..... A63B 22/0056 188/83
4,501,421 A * 2/1985 Kane ..... A63B 23/085 482/118
4,693,470 A * 9/1987 Ogawa ..... A63B 21/00047 482/79
4,739,986 A * 4/1988 Kucharik ..... A63B 23/08 482/146
5,035,421 A * 7/1991 Scheller ..... A63B 21/023 482/130
5,056,507 A * 10/1991 Yum ..... A61H 7/001 601/136
5,433,684 A * 7/1995 Carrillo ..... A63B 23/085 482/123
5,645,516 A * 7/1997 Foster ..... A63B 21/0004 482/121
D383,813 S * 9/1997 Zoller ..... D21/685
5,897,464 A * 4/1999 Mcleod ..... A63B 23/08 482/132
5,984,841 A * 11/1999 John ..... A63B 22/0056 482/52
6,063,013 A * 5/2000 Vathappallil ..... A63B 21/023 482/120

(Continued)

*Primary Examiner* — Andrew S Lo
(74) *Attorney, Agent, or Firm* — Mark C. Johnson; Johnson Dalal

(57) ABSTRACT

A calf stretching apparatus having a base having a lower surface defining a lower surface plane, a front end, a rear end opposing the rear end of the base, the rear end of the base having a rear edge defining a recessed base through opening and a foot placement platform with a front end, a rear end opposing the front end of the foot placement platform, a platform surface spanning in an upward direction with respect the base from the front end of the foot placement platform to the rear end of the foot placement platform and disposed at an acute angle with respect to the lower surface plane, a platform sidewall surrounding the platform surface on three sides thereof, wherein the rear end of the foot placement platform has a rear edge defining a recessed platform through opening aligned with the recessed base through opening.

19 Claims, 11 Drawing Sheets

(56) References Cited

U.S. PATENT DOCUMENTS

| | | | | |
|---|---|---|---|---|
| 6,589,141 | B1 * | 7/2003 | Flaggs | A63B 23/04 482/79 |
| 6,821,235 | B1 * | 11/2004 | Johnson | A63B 21/0552 482/146 |
| 6,935,991 | B1 * | 8/2005 | Mangino | A61H 1/0237 36/140 |
| 7,169,098 | B1 | 1/2007 | McGanty | |
| 7,364,534 | B2 * | 4/2008 | Zoller | A63B 23/08 482/79 |
| D596,246 | S * | 7/2009 | Nofsinger | D21/685 |
| D622,789 | S * | 8/2010 | Gillis | D21/685 |
| 7,857,733 | B2 | 12/2010 | Tsakiris | |
| D631,107 | S * | 1/2011 | Gillis | D21/685 |
| 8,360,940 | B2 | 1/2013 | Kole et al. | |
| 9,415,260 | B2 * | 8/2016 | Islas | A63B 23/10 |
| 2002/0165069 | A1 * | 11/2002 | Ravikumar | A63B 23/10 482/80 |
| 2004/0009850 | A1 * | 1/2004 | Teff | A63B 21/0552 482/79 |
| 2010/0035734 | A1 * | 2/2010 | DiGiovanni | A63B 23/085 482/79 |
| 2011/0124473 | A1 * | 5/2011 | Kole | A63B 21/028 482/79 |
| 2014/0100086 | A1 | 4/2014 | Pagliaro | |
| 2014/0342881 | A1 * | 11/2014 | Almarales | A61H 1/0266 482/91 |

* cited by examiner

CALF STRETCHING APPARATUS

FIELD OF THE INVENTION

The present invention relates generally to leg muscle stretching devices, and, more particularly, relates to a calf muscle stretching apparatus.

BACKGROUND OF THE INVENTION

Whether it is in anticipation of or post physical activity, stretching is an important exercise for a person to employ. Generally, stretching includes intentionally or deliberately flexing or extending a joint and lengthening a specific muscle or tendon (or muscle group) in order to improve a muscle's felt elasticity, length, or tension relationship and/or achieve comfortable muscle tone. The result is a restoration of appropriate muscle length, leading to a feeling of increased muscle control, flexibility, and range of motion. Stretching is also used therapeutically to alleviate cramps and chronically shortened, dysfunctional muscles due to maladaptive joint positions such as high heel shoes and prolonged desk sitting. In its most basic form, stretching is a natural and instinctive activity; thus, it is performed by humans. Increasing flexibility through stretching is one of the basic tenets of physical fitness. Stretching is also common for athletes to stretch before (for warming up) and after various exercises to reduce risk of injury and increase performance. In sports medicine, it has been found that limitations in normal ankle dorsiflexion range of motion (ROM) from tight calf muscles is directly linked to pathologies such as Achilles tendonitis, calf tears and plantar fasciitis (Muir, Chemsworth, Vandervoort 1999). Stretching can also be dangerous when performed incorrectly. There are many techniques for stretching in general, but depending on which muscle group is being stretched, some techniques may be ineffective or detrimental, even to the point of causing hypermobility, instability, or permanent damage to the tendons, ligaments, and muscle fiber.

Stretching a muscle in a user's lower extremity, e.g., the calf or ankle area near the Achilles tendon, can be particularly problematic for many users based on the location of the muscle, the passive resistance of the muscle and the very nature of the lever system the calf muscle is exerting force upon. Specifically, the calf is the back portion of the lower leg and muscles within the calf correspond to the posterior compartment of the leg. The two largest muscles within this compartment are known together as the calf muscle and attach to the heel via the Achilles tendon. These muscles exert force upon the heel bone which in turn drives the ball of the foot (metatarsal heads) into the ground with mechanical advantage due to force being driven through a type 2 lever system (there are Type 1, 2 and 3 lever systems in the human body). In order to drive this lever system in reverse, thus driving the ball of the foot away from the ground via the heel bone fulcrum and in turn exerting a lengthening force upon the calf complex, the heel bone must be held tightly to avoid translation and allow leveraged force to be exerted upon the calf; much like a beer bottle opener must be fixed firmly on the lip of the bottle neck to allow the cap to be levered upward. For this reason, the heel bone must be held firmly at or above the Achilles insertion for true leveraged force to be applied through both the ball of the foot and heel bone simultaneously. Although other stretching devices may provide body weight force to the ball of the foot, no other device fixes the heel above its fulcrum point to allow the body to drive over the heel and provide true mechanical advantage and maximal torque to overcome passive calf muscle resistance.

Several known lower extremity stretching devices are part of larger stretching devices that are aimed to stretch a variety of different muscle groups of a user's body. As such, theses devices are large and cumbersome, in addition to being time- and cost-intensive in regard to the device's installation, disassembly, and maintenance. Therefore, these larger devices are commercially impracticable for most consumers. Further, these known devices also fail to provide effective retention of a user's heel or foot when engaged in the calf stretching exercises.

Other known lower extremity stretching or exercising devices may be portable and/or aimed specifically at stretching a user's calf, but these devices also suffer from several disadvantages. Specifically, these devices generally include a body supported on a round surface, wherein the body includes an inclined platform surface where a user will place his or her foot before engaging in a stretching activity. These are roller-type calf stretchers, where the foot is locked into a half moon shaped shoe holder. The user leans forward and the calf muscles stretch under body weight only, similar to dropping the heel from a step. This method provides some stretch to the calf, but does not allow a deeper leveraged stretch by retaining the heel above the fulcrum point. Furthermore, it does not allow the user to lever over the top of the heel on a fixed base as these devices rock forward which does not allow any further stretch beyond body weight. It is not easy to balance while using this stretching device. This can be extremely dangerous for the elderly and/or anyone who lacks good coordination. Moreover, the foot is not in an optimal position to get the best stretch, and the user tends to bend their knee to maintain balance rather than hyperextending it when stretching the calf. This can be very awkward to use and even difficult for elderly individuals and those with lower extremity arthritis or other painful conditions. Thus, compliance with recommended stretching is diminished significantly and therefore individuals may not improve their condition.

Other known lower extremity stretching or exercising devices, such as U.S. Pat. No. 8,360,940 (Kole et al.), include an inclined or angled foot platform with a lower heel retention portion. However, these devices are designed to accomplish multiple stretching techniques of a user's lower leg or foot. To that end, the device is intentionally designed to make the heel portion translate or adjust leading to failure when significant weight is subjected thereon. Additionally, these devices include other exercising components that prevents the user to stretch effectively. Further, these devices also do not provide an effective and comfortable means to retain a user's heel firmly above the fulcrum point which would otherwise fix the heel during the stretching process and prevents the device from shifting when in use and subject to the weight of a user.

Therefore, a need exists to overcome the problems with the prior art as discussed above.

SUMMARY OF THE INVENTION

The invention provides a calf stretching apparatus that overcomes the hereinafore-mentioned disadvantages of the heretofore-known devices and methods of this general type and that effectively, safely, and comfortably permits a user to stretch his or her calf and other muscles in a user's lower extremity.

With the foregoing and other objects in view, there is provided, in accordance with the invention, a calf stretching apparatus that includes a handheld body with a base and foot placement platform. The base includes a lower surface defining a lower surface plane, a front end, a rear end opposing the rear end of the base. The platform surface spans in an upward direction with respect to the base from the front end of the foot placement platform to the rear end of the foot placement platform, and also includes a platform sidewall surrounding the platform surface on three sides thereof. Beneficially, the platform also includes an arcuate heel sidewall interposed thereon, wherein the platform surface has a first platform surface disposed adjacent to the arcuate heel sidewall and of a parallel orientation with respect to the lower surface plane and a second platform surface disposed at the acute angle with respect to the lower surface plane, the first platform surface interposed between the arcuate heel sidewall and the second platform surface and disposed at an obtuse angle with respect to the second platform surface.

In accordance with another feature, an embodiment of the present invention includes the rear end of the base has a rear edge defining a recessed base through opening that may receive a door stop of a door jamb and the rear end of the foot placement platform has a rear edge defining a recessed platform through opening aligned with the recessed base through opening that may also receive a door stop of a door jamb.

In accordance with another feature, an embodiment of the present invention includes a base having a left side, a right side opposing the left side of the base, and a rear base width along the rear edge of the base separating the left and right sides of the base, wherein the recessed base through opening is centrally disposed along the rear base width.

In accordance with a further feature of the present invention, the platform surface is substantially planar and terminates at the rear end of the foot placement platform. The platform surface may also be disposed approximately at a 45° angle with respect to the lower surface plan. The platform surface may also span linearly in the upward direction from the front end of the foot placement platform to the rear end of the foot placement platform In accordance with yet another feature, an embodiment of the present invention also includes the platform surface having a first platform surface disposed adjacent to the arcuate heel sidewall and of a parallel orientation with respect to the lower surface plane and a second platform surface disposed at the acute angle with respect to the lower surface plane, wherein the first platform surface is interposed between the arcuate heel sidewall and the second platform surface.

In accordance with a further feature, an embodiment of the present invention also includes the rear edge of the base having two opposing lateral sidewalls and a middle sidewall oriented in an orthogonal orientation with respect to the lower surface plane and defining the recessed base through opening. The rear edge of the platform may also have two opposing lateral sidewalls and a middle sidewall oriented in an orthogonal orientation with respect to the lower surface plane and defining the recessed platform through opening.

In accordance with an additional feature, an embodiment of the present invention includes a median axis spanning through a centroid defined by the platform surface, wherein the platform is symmetrically configured with respect to the median axis.

In accordance with another feature of the present invention, the recessed base through opening and the recessed platform through opening substantially correspond in shape to on another.

In accordance with the present invention, the apparatus may be utilized in combination with a door frame defining a door opening and having a door jamb including a door stop protruding therefrom. Specifically, the apparatus may include a calf stretching body with a base having a lower surface defining a lower surface plane, a front end, a rear end opposing the rear end of the base, wherein the rear end of the base having a rear edge defining a recessed base through opening. The body also includes a foot placement platform with a front end, a rear end opposing the front end of the foot placement platform, a platform surface spanning in an upward direction with respect the base from the front end of the foot placement platform to the rear end of the foot placement platform and disposed at an acute angle with respect to the lower surface plane, an arcuate heel sidewall disposed proximal to the rear end of the foot placement platform, wherein the rear end of the foot placement platform having a rear edge defining a recessed platform through opening aligned with the recessed base through opening. The apparatus has an installed position along a body translation path with the calf stretching body disposed within the door opening of the door frame and with the door stop disposed within the recessed based through opening and the recessed platform through opening.

In accordance with another feature, an embodiment of the present invention also includes the installed position having the door stop completely within the recessed based through opening and the recessed platform through opening.

Although the invention is illustrated and described herein as embodied in a calf stretching apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the platform of the apparatus.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
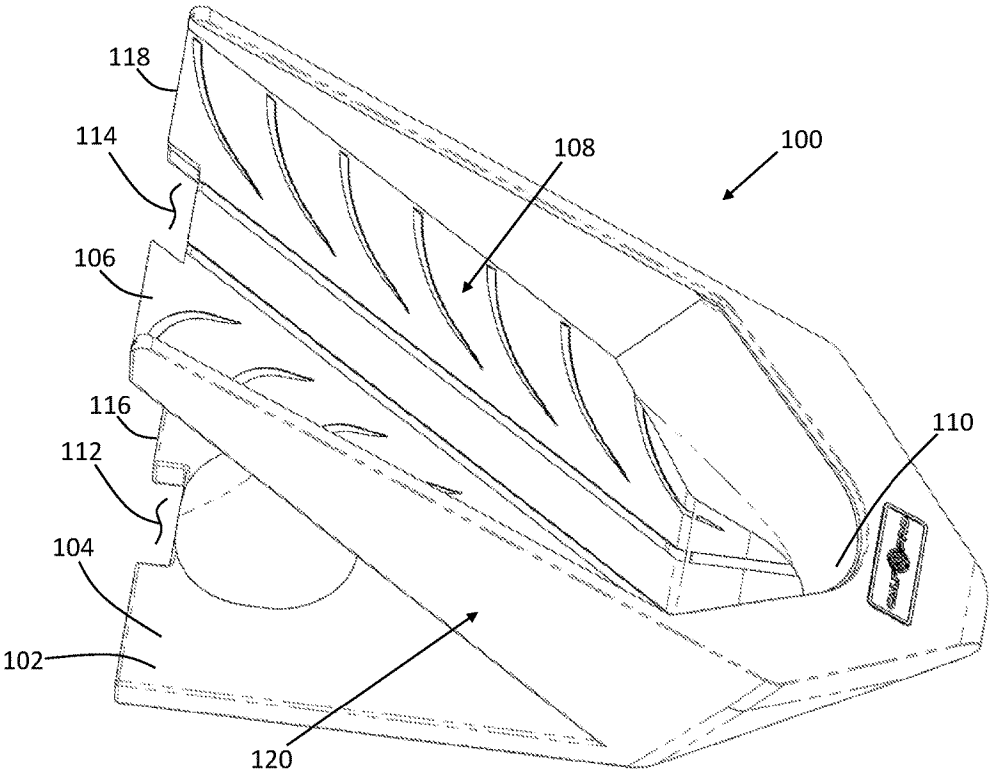
FIG. 1 is a perspective downward-looking front view of a calf stretching apparatus in accordance with one embodiment of the present invention.
Figure 2:
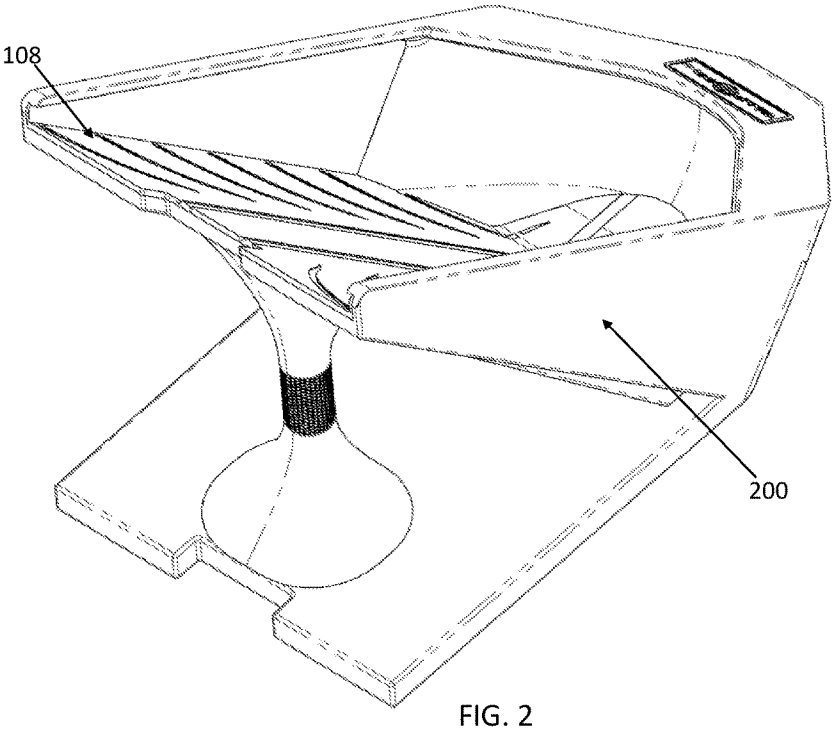
FIG. 2 is a perspective downward-looking rear view of the calf stretching apparatus of FIG. 1.
Figure 4:
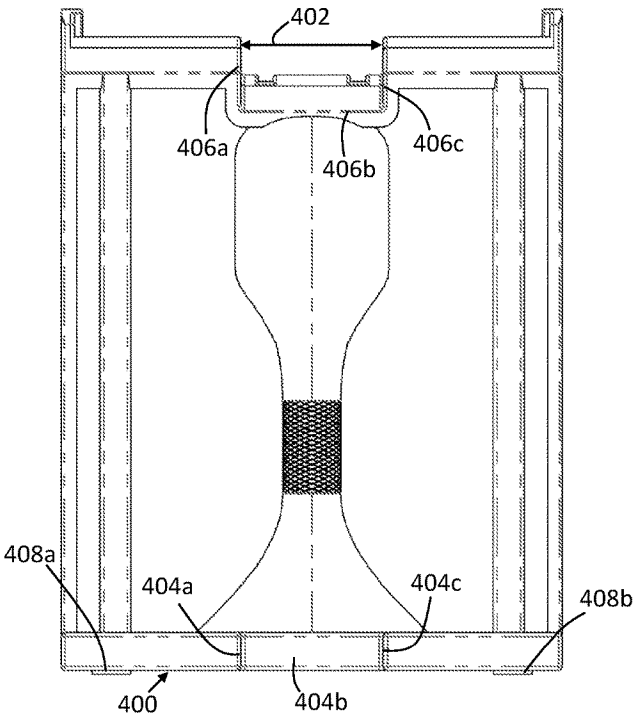
FIG. 4 is an elevational rear view of the calf stretching apparatus of FIG. 1.
Figure 3:
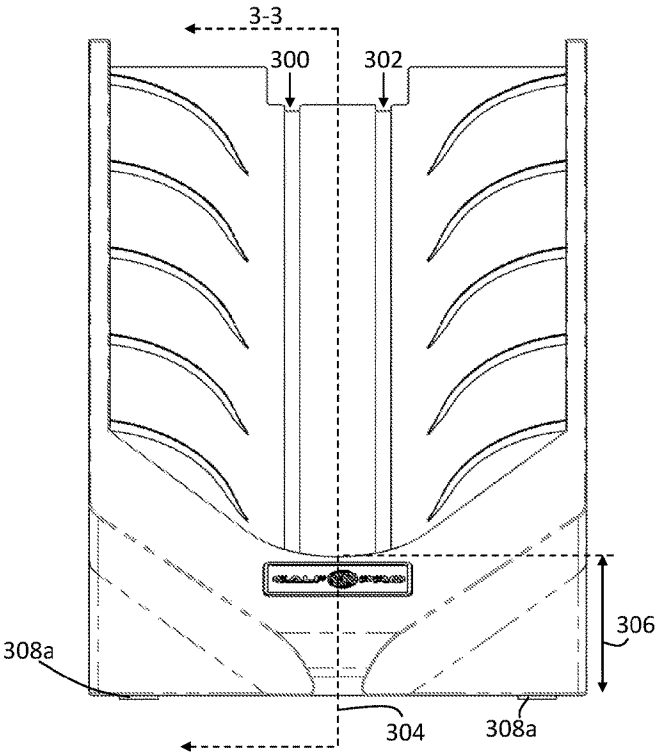
FIG. 3 is an elevational front view of the calf stretching apparatus of FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient calf stretching apparatus that enables users to safely, comfortably, and effectively stretch their calf muscle or other muscle, tendon, and/or tissue located in the user's lower extremity, e.g., Achilles tendon. Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a calf stretching apparatus 100, as shown in FIG. 1, includes a calf stretching body 102 with a base 104 and a foot placement platform 106. The apparatus 100 beneficially includes an inclined ramp or platform surface 108 where a user places his or her foot in the stretching exercise, along with an arcuate heel sidewall 110. The apparatus 100 also beneficially includes a recessed base through opening 112 and a recessed platform through opening 114 which are shaped and sized to receive a door stop 1004 disposed on a door jamb 1002 or a door frame 1000.

Beneficially, the apparatus 100, or body 102, is handheld, or capable of being carried by a single user. Said another way, the apparatus is also easily portable and movable to a desired exercise or application position with little effort by the user. To effectuate the same, the body 102 may be unitary, or a single molded or assembled piece of material that is light in weight, e.g., less than 5-10 lbs. In one embodiment, the body 102 is of a rigid polymeric material, e.g., PVC or HDPE having a hardness of approximately 30 Shore D or greater. In other embodiments, the body 102 may be of a rigid metallic material.

Referring to FIGS. 1-4 and 7, the base 104 includes a lower surface 400 defining a lower surface plane 700, a front end 702, a rear end 704 opposing the rear end of the base 104. Similarly, the foot placement platform 106 has a front end 706, a rear end 708 opposing the front end 706 of the foot placement platform 106. In one embodiment, the front ends 702, 706 of the base 104 and platform 106, respectively, may meet at a joint where the platform 106 begins to extend upwardly from the front ends 702, 706. Beneficially, the rear ends 704, 708 of the base 104 and platform 106 have rear edges 116, 118 defining the recessed base and platform through openings 112, 114, respectively. The openings 112, 114 are "through" openings in that they permit the door jamb 1002, door stop 1004, or other structure to be inserted therein without inhibition, thereby preventing lateral movement of the apparatus 100.

In one embodiment, the openings 112, 114 are shaped and sized to receive and/or contour a convention door stop cross-section or width. The openings 112, 114 may be rectangular, an oblong shape, or another shape to receive door structures. In one embodiment, the width 402 of the openings 112, 114 are approximately 1-3 inches, but is preferably approximately 1.85 inches. Further, the width of the base 104 and/or platform 106 may be approximately 5-7 inches but is preferably approximately 6 inches. The platform 106 may have a front portion with a height 306 extending from the lower surface 400 of approximately 1.8 inches. Other dimensions, however, may be given based on design constraints and application of the device 100. The openings 112, 114 are also disposed at the distal or terminal end of the base 104 and platform 106. In preferred embodiments, the openings 112, 114 may be aligned with one another and correspond in shape and size to one another to permit the apparatus to fit flush to the door stop.

The rear edges 116, 118 may also define two sub-bored recesses 300, 302 defined thereon for accommodating a door stop and/or facilitating in the removal of the apparatus from the door stop. Each of the sub-bored recesses 300, 302 may also be disposed in a symmetric configuration with respect to one another about a median axis 304 spanning through a centroid defined by the platform surface 108. The rear ends 704, 708 of the base 104 and platform 106 also may have two opposing lateral sidewalls and a middle sidewall 404*a-c*, 406*a-c*, respectively. The sidewalls 404*a-c*, 406 may be oriented in an orthogonal orientation with respect to the lower surface plane 700 and can be seen defining the respective recessed base and platform through openings 112, 114. As such, the orientation of the sidewalls 404*a-c*, 406*a-c* provides a more stable device when in use and force is applied to platform surface 108. To that end and to effectuate a more stable apparatus, the platform 106 and/or the base 104 may also be symmetrically configured with respect to the median axis 304.

The apparatus 100, namely the base 104 and platform 106, also include a left side 120, a right side 200 opposing the left side 120. Along the rear base or platform width, defined by the rear edges 116, 118 of the base 106 and platform 108, respectively, and separating the left and right sides 120, 200, the recessed base and platform through openings 112, 114 may be centrally disposed thereon. For example, if the width of the rear end 704 be approximately 6 inches, the recessed base through opening 112 would be approximately disposed, preferably symmetrically, 3 inches along the rear edge 116. In one embodiment, the platform 106 includes sidewalls 110 that surrounds the platform surface 108 on three sides. The sidewalls 110 flanking the platform surface 108 may taper in height and lateral width between one another as the platform 106 extends upwardly toward the distal end 708 to more effectively contour a user's foot.

Still referring to FIGS. 1-4, 7, and 9, the platform surface 108 can be beneficially seen spanning in an upward direction with respect to the base 104 from the front end 706 of the foot placement platform 106 to the rear end 708 of the foot placement platform 106 and disposed at an acute angle, θ, with respect to the lower surface plane 700. In one embodiment, the angle is approximately 45° (+/−10°) and continually spans upwardly at said angle until the distal terminal end 708. In some embodiments, the platform surface 108 is substantially planar and terminates at the rear end of the foot placement platform 106. The platform surface 108 may also include a friction-inducing material substantially covering the platform surface 108 to reduce the likelihood of a user's foot slipping. In one embodiment, the friction-inducing material may be natural rubber, or another friction-inducing material. The lower surface 400 of the base 104 may also include a plurality of legs 308*a-b*, 408*a-b* coupled thereto, wherein each leg may be of an adjustable or set length that is uniform with one another. The legs 308*a-b*, 408*a-b* may include the friction-inducing material disposed at the bottom thereof to reduce the likelihood of the device shifting while in use.

To effectuate the optimal stretching configuration of a user's foot, the platform surface 108 includes a first platform surface 900 disposed adjacent to the arcuate heel sidewall 110 and is disposed in a parallel orientation with respect to the lower surface plane 700. As used herein, "parallel" shall be defined as "substantially parallel." The first platform surface 900 may span approximately 2-3 inches and may also be substantially planar. The platform surface 108 may also include a second platform surface 902 that is disposed at the acute angle, θ, with respect to the lower surface plane 700 and may also be substantially planar, like the lower surface 400 of the base. The is interposed between the arcuate heel sidewall 110 and the second platform surface 902. The length of the second platform surface 902 may be a length 904 of approximately 11-12 inches. The length of the base 104 may be a length 906 of approximately 12-13 inches. As such, the user's foot, when placed in a stretching position on the platform surface 108, is angled in an orientation conducive for stretching muscles in the user's lower extremity.

The platform surface 108 may span linearly in the first platform surface 900 upward direction, away from an upper surface 910 of the base, from the front end of the foot placement platform to the rear end of the foot placement platform. In one embodiment, the first platform surface 900 proximal to the arcuate sidewall 110 may have a cover disposed over a portion thereof for the heel of the user to seat and conform therein. To provide comfort and grip to the user's bare foot, the arcuate sidewall 110 and first platform surface 900 may also include a friction-inducing material and/or a deformably resilient material, e.g., an elastomer, superimposed thereon. As such, the platform surface 108 acts as a ramp that allows a user to stretch his or her calf muscle or other muscles of a user's lower extremity.

Figure 6:
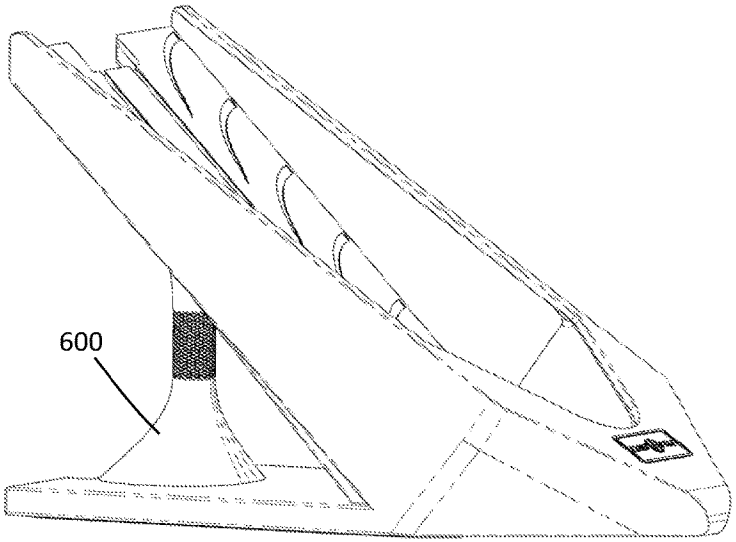
FIG. 6 is another perspective downward-looking front view of the calf stretching apparatus of FIG. 1.
Figure 5:
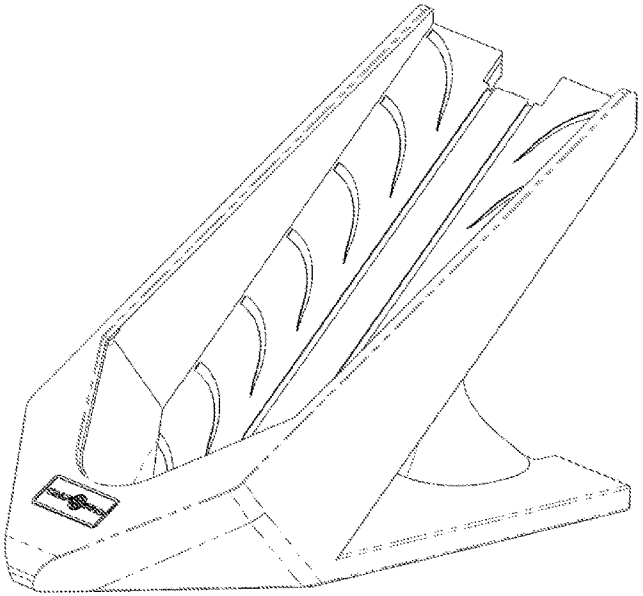
FIG. 5 is another perspective downward-looking front view of the calf stretching apparatus of FIG. 1.
Figure 8:
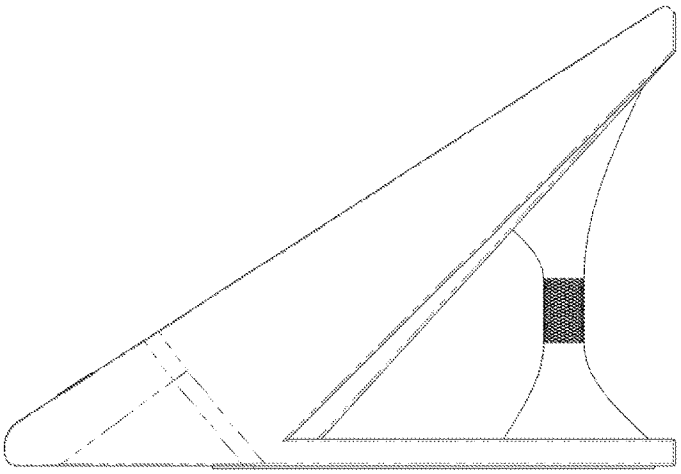
FIGS. 7 and 8 are elevational side views of the calf stretching apparatus of FIG. 1.
Figure 7:
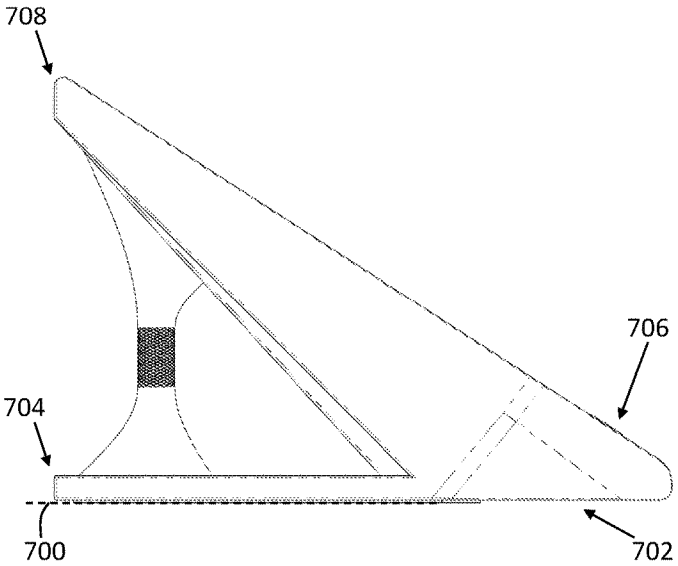
Figure 9:
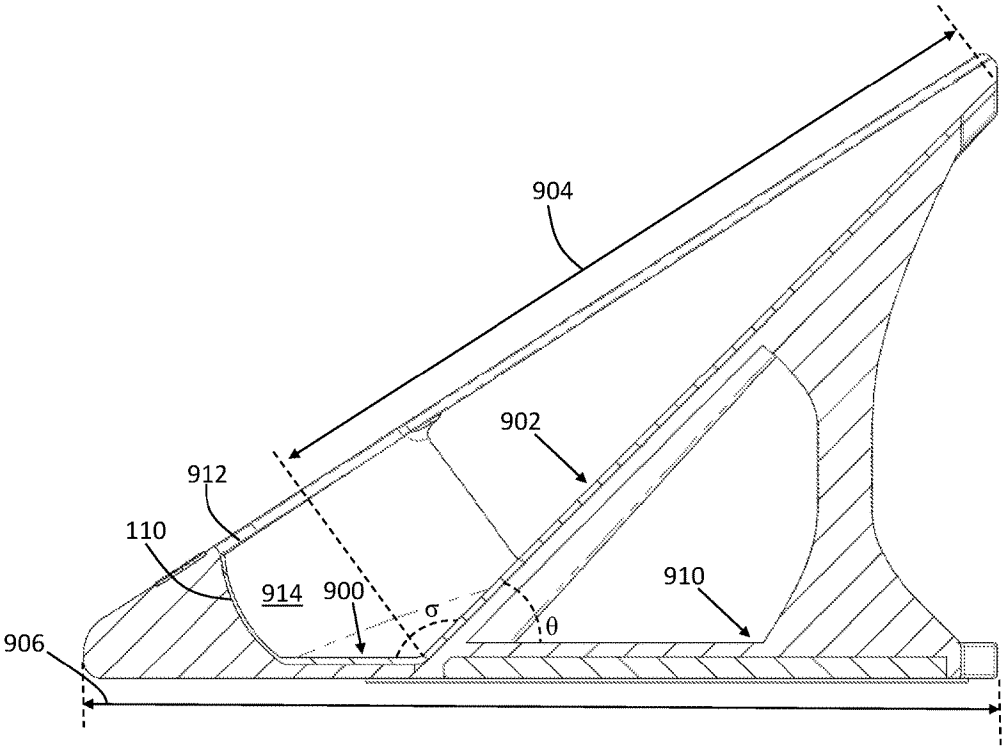
FIG. 9 is a cross-sectional view along section line 3-3 of the apparatus depicted in FIG. 3.

With reference to FIG. 6, the apparatus 100 may include a main brace 600 defining an aperture in the back or rear portion that may also act as a handle to easily carry the apparatus effectively. In other embodiments, the apparatus 100 may include one or more handle(s) located in other portions to carry around the apparatus 100.

Figure 10:
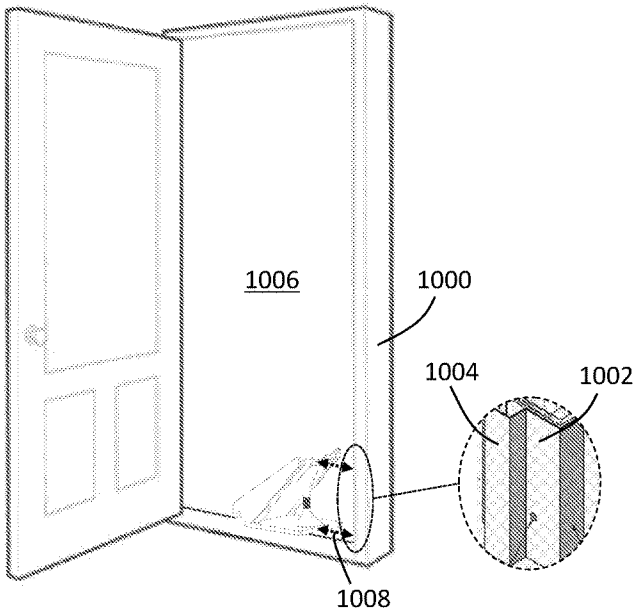
FIG. 10 is a perspective downward-looking rear view of the calf stretching apparatus of FIG. 1.
Figure 12:
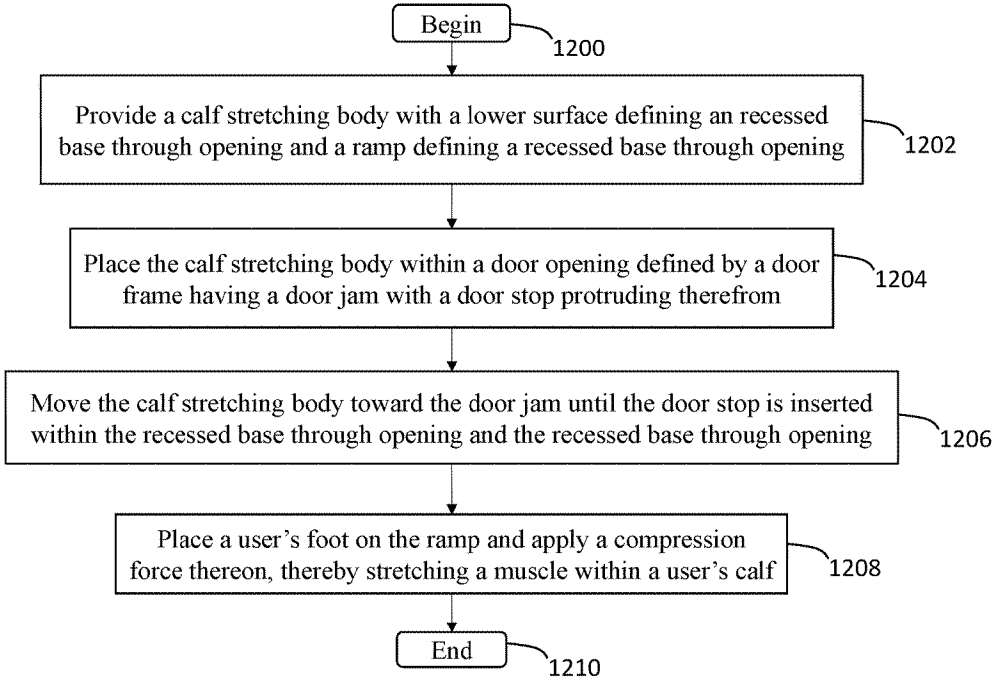
FIG. 12 is a process flow diagram depicting a method of installing and using a calf stretching device in accordance with one embodiment of the present invention.

FIGS. 1 and 10 will be described in conjunction with the process flow chart of FIG. 12. Although FIG. 12 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 12 for the sake of brevity. In some embodiments, some or all of the process steps included in FIG. 12 can be combined into a single process.

The process begins at step 1200 and immediately proceeds to step 1202 of providing a calf stretching body/apparatus with many of the features and components disrobed above. In particularly, the apparatus 100 is employed in combination with a door frame 1000 defining a door opening 1006 and having a door jamb 1002 including a door stop 1004 protruding therefrom. Next, step 1204 includes the user placing the calf-stretching body 102 within the door opening 1006 for placement against the door jamb 1002. Next, step 1206 includes moving the calf stretching body 102 toward the door jamb 1002 until the door stop 1004 is inserted within the recessed base and platform through openings 112, 114. Once the apparatus 100 reaches the door jamb 1002, the apparatus 100 is placed in the installed position along a body translation path, represented with arrow 1008. with the calf stretching body disposed within the door opening and the door stop 1004 disposed within the openings 112, 114.

When the door stop 1004 is inserted within the openings 112, 114, and the user applies a compressive force on top of the platform surface 108, the sidewalls 404*a-c*, 406*a-c*, prevent lateral or side-to-side movement of the apparatus and the door jamb 1002 prevents longitudinal movement of the apparatus 100 toward the application direction of force generated by the user's foot. To that end, step 1208 includes the user placing his or her foot on the platform surface 108 or ramp and apply the compression force thereon, thereby stretching of the user's muscles within the user's calf and/or other areas of the user.

More specifically, step 1208 may include placing the user's foot on the ramp 108 and allow it to slide down until a rear portion of a user's heel is placed adjacent to the heel sidewall 110 and a bottom portion of the user's heal is supported and placed adjacent to the first platform surface 900. Beneficially, the heel sidewall 110 and the first platform surface 900 may contour and/or hold the user's heel tightly in place. The heel sidewall 110 and first platform surface 900 may also define a heel placement zone 914 shaped and sized to receive the user's heel. In some embodiments, the heel placement zone 914 may be shaped and sized to be less than the shape and size of an adult user's heel, e.g., a spherical or curved shape that is 1-3 inches in width and length and 1-3 inches in height.

In one embodiment, the sidewall 110 and/or first platform surface 902 may include the elastically deformably resilient material disposed thereon to facilitate in said snug configuration between the apparatus 100 and the user's heel. In some embodiments, the apparatus may also include hood or cover 912 that also facilitates in keeping the user's heel in the snug configuration with the apparatus 100. The arch, instep, and sole of the user's foot may be placed adjacent to and/or be supported on the second platform surface 904.

After placement on the apparatus 100, the user's body and straight leg are then driven over the secured heel toward the door jamb, thereby applying a lengthening force to stretch the user's calf muscle. Specifically, for true leveraged force to be applied through both the ball of the foot and heel bone simultaneously, the heel sidewall 110 and first platform surface 900, or other portions of the apparatus 100, fixes the heel above the fulcrum point to allow the body to drive over the heel and provide true mechanical advantage and maximal torque to overcome passive calf muscle resistance. To facilitate in said foot orientation/configuration, the first and second platform surface 900, 902 may also be disposed at an obtuse angle $\sigma$ with respect to one another, e.g., 100-150°.

The process may terminate at step 1210. As such, a calf stretching apparatus is disclosed that enables users to safely, comfortably, and effectively stretch their calf muscle or other muscle, tendon, and/or tissue located in the user's lower extremity.

Figure 11:
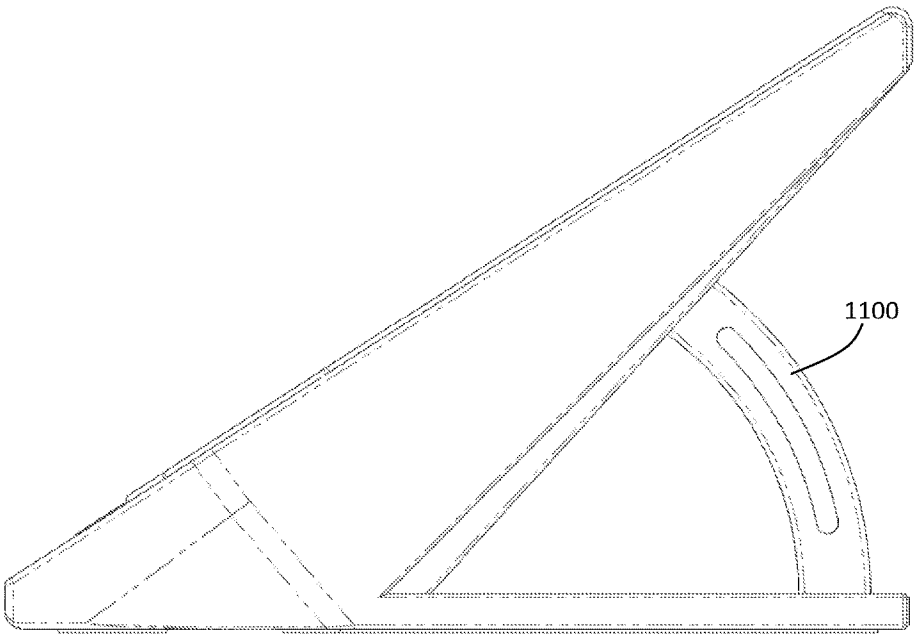
FIG. 11 is a side elevational view (the right and left sides are identical) of a calf stretching apparatus in accordance with another embodiment of the present invention.
Figure 13:
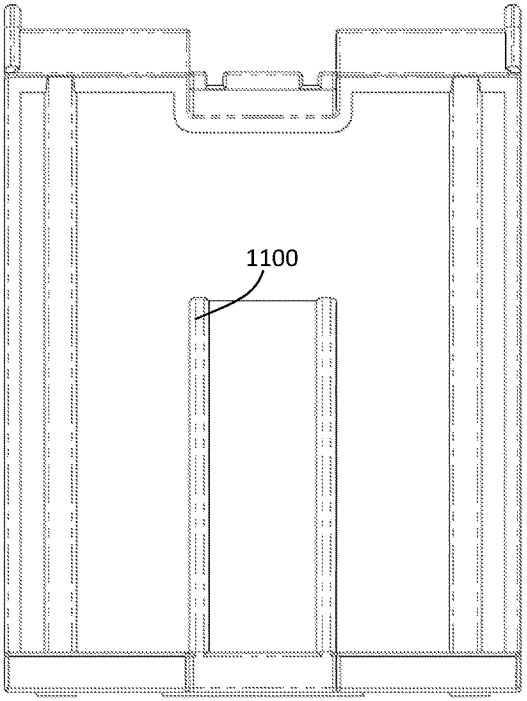
FIG. 13 is an elevational rear view of the calf stretching apparatus of FIG. 11.
Figure 14:
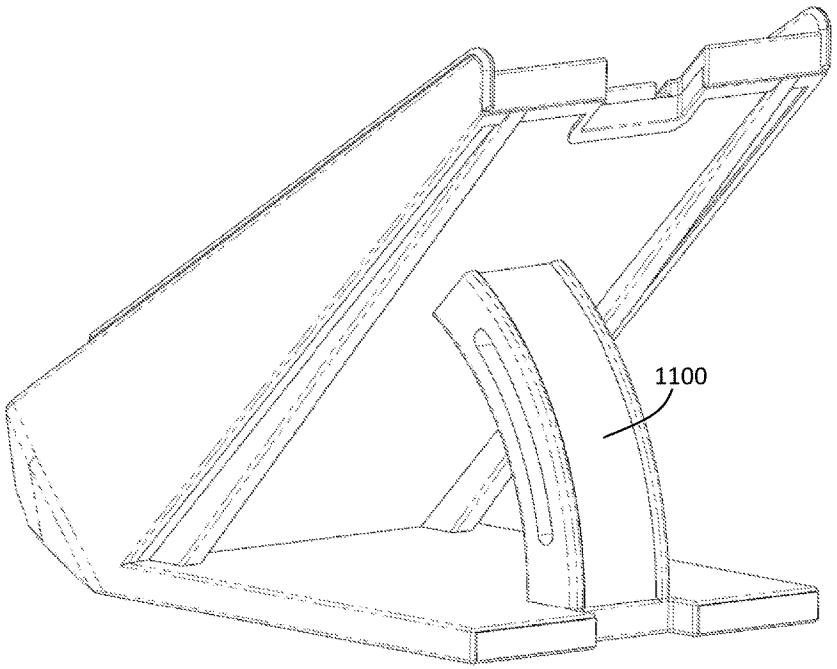
FIG. 14 is a perspective view of the calf stretching apparatus of FIG. 11.

As shown best in FIGS. 11 and 13-14, another embodiment of a calf stretching apparatus is shown with the rear support/handle portion 1100 is of an arcuate shape. In one embodiment the rear support may be static. In another embodiment, the rear support 1100 may be of telescopic sections operably configured to lock and set, e.g., using an aperture/spring-loaded nodule configuration, at a desired angle of the platform surface.

What is claimed is:

1. A calf stretching apparatus comprising:

a handheld body with:

a base having a lower surface defining a lower surface plane, a front end, a rear end opposing the front end of the base; and a foot placement platform with a front end, a rear end opposing the front end of the foot placement platform, a platform surface spanning in an upward direction with respect to the base from the front end of the foot placement platform to the rear end of the foot placement platform, and a platform sidewall surrounding the platform surface on three sides thereof and including an arcuate heel sidewall interposed thereon, the platform surface having:

a first platform surface disposed adjacent to the arcuate heel sidewall and of a parallel orientation with respect to the lower surface plane; and a second platform surface disposed at an acute angle with respect to the lower surface plane, the first platform surface interposed between the arcuate heel sidewall and the second platform surface and disposed at an obtuse angle with respect to the second platform surface.

2. The calf stretching apparatus according to claim 1, wherein:

the rear end of the base includes a rear edge defining a recessed base through opening; and the rear end of the foot placement platform includes a rear edge defining a recessed platform through opening aligned with the recessed base through opening.

3. The calf stretching apparatus according to claim 2, wherein the base further comprises:

a left side, a right side opposing the left side of the base, and a rear base width along the rear edge of the base separating the left and right sides of the base, wherein the recessed base through opening is centrally disposed along the rear base width.

4. The calf stretching apparatus according to claim 2, wherein:

the recessed base through opening and the recessed platform through opening substantially correspond in shape to one another.

5. The calf stretching apparatus according to claim 2, wherein the rear edge of the base further comprises:

two opposing lateral sidewalls and a middle sidewall oriented in an orthogonal orientation with respect to the lower surface plane and defining the recessed base through opening.

6. The calf stretching apparatus according to claim 5, wherein the rear edge of the foot placement platform further comprises:

two opposing lateral sidewalls and a middle sidewall oriented in an orthogonal orientation with respect to the lower surface plane and defining the recessed platform through opening.

7. The calf stretching apparatus according to claim 1, wherein:

the platform surface is substantially planar and terminates at the rear end of the foot placement platform.

8. The calf stretching apparatus according to claim 1, wherein:

the platform surface is disposed approximately at a 45° angle with respect to the lower surface plane.

9. The calf stretching apparatus according to claim 1, further comprising:

a median axis spanning through a centroid defined by the platform surface, wherein the foot placement platform is symmetrically configured with respect to the median axis.

10. The calf stretching apparatus according to claim 1, wherein:

the platform surface spans linearly in the upward direction from the front end of the foot placement platform to the rear end of the foot placement platform.

11. In combination with a door frame defining a door opening and having a door jamb including a door stop protruding therefrom, wherein the improvement comprises:

a calf stretching body with:

a base having a lower surface defining a lower surface plane, a front end, a rear end opposing the front end of the base, the rear end of the base having a rear edge defining a recessed base through opening; and a foot placement platform with a front end, a rear end opposing the front end of the foot placement platform, a platform surface spanning in an upward direction with respect to the base from the front end of the foot placement platform to the rear end of the foot placement platform and disposed at an acute angle with respect to the lower surface plane, an arcuate heel sidewall disposed proximal to the rear end of the foot placement platform, the rear end of the foot placement platform having a rear edge defining a recessed platform through opening aligned with the recessed base through opening; and an installed position along a body translation path with the calf stretching body disposed within the door opening of the door frame and with the door stop disposed within the recessed base through opening and the recessed platform through opening.

12. The improvement according to claim 11, wherein the installed position further comprises:

the door stop completely within the recessed base through opening and the recessed platform through opening.

13. The improvement according to claim 11, wherein the foot placement platform further comprises:

a platform sidewall surrounding the platform surface on three sides thereof and with the arcuate heel sidewall interposed thereon.

14. The improvement according to claim 11, wherein the base further comprises:

a left side, a right side opposing the left side of the base, and a rear base width along the rear edge of the base separating the left and right sides of the base, wherein the recessed base through opening is centrally disposed along the rear base width.

15. The improvement according to claim 11, wherein:

the platform surface is substantially planar, terminates at the rear end of the foot placement platform, and is disposed approximately at a 45° angle with respect to the lower surface plane.

16. The improvement according to claim 11, wherein the platform surface further comprises:

a first platform surface disposed adjacent to the arcuate heel sidewall and of a parallel orientation with respect to the lower surface plane and a second platform surface disposed at the acute angle with respect to the lower surface plane, the first platform surface interposed between the arcuate heel sidewall and the second platform surface.

17. The improvement according to claim 11, further comprising:

the rear edge of the base having two opposing lateral sidewalls and a middle sidewall oriented in an orthogonal orientation with respect to the lower surface plane and defining the recessed base through opening; and the rear edge of the foot placement platform having two opposing lateral sidewalls and a middle sidewall oriented in an orthogonal orientation with respect to the lower surface plane and defining the recessed platform through opening.

18. The improvement according to claim 11, wherein:

the platform surface spans linearly in the upward direction from the front end of the foot placement platform to the rear end of the foot placement platform.

19. The improvement according to claim 11, wherein:

the recessed base through opening and the recessed platform through opening substantially correspond in shape.

* * * * *